United States Patent [19]

Lynch

[11] 4,070,132

[45] Jan. 24, 1978

[54] VARIABLE PERFORMANCE PUMP

[75] Inventor: Charles Thomas Lynch, Berkeley, Calif.

[73] Assignee: Baltimore Aircoil Company, Inc., Jessup, Md.

[21] Appl. No.: 737,964

[22] Filed: Nov. 2, 1976

[51] Int. Cl.[2] ..... F01D 7/00

[52] U.S. Cl. ..... 415/48; 415/131; 415/140

[58] Field of Search ..... 415/140, 141, 131, 48, 415/46, 148

[56] References Cited

U.S. PATENT DOCUMENTS

| | | | |
|---|---|---|---|
| 1,837,887 | 12/1931 | Schmidt | 415/131 |
| 2,341,985 | 2/1944 | Green | 415/128 |
| 2,358,744 | 9/1944 | Stepanoff | 415/131 X |
| 2,927,536 | 3/1960 | Rhoades | 415/48 |
| 2,957,454 | 10/1960 | Brundage et al. | 415/48 |
| 2,992,617 | 7/1961 | Kroeger | 415/204 |
| 3,003,313 | 10/1961 | Bunger | 415/141 X |
| 3,228,656 | 1/1966 | Kyogoku | 415/131 |
| 3,365,120 | 1/1968 | Jassniker | 415/158 X |
| 3,407,740 | 10/1968 | Samerdyke | 415/131 |
| 3,499,388 | 3/1970 | Eberhardt | 415/132 |
| 3,806,278 | 4/1974 | Grennan | 415/140 |
| 3,918,831 | 11/1975 | Grennan | 415/140 |

FOREIGN PATENT DOCUMENTS

| | | | |
|---|---|---|---|
| 466,538 | 11/1951 | Italy. | |
| 41,463 | 4/1937 | Netherlands. | |
| 3,326,909 | 3/1970 | United Kingdom | 415/141 |
| 670,527 | 4/1952 | United Kingdom | 415/141 |

*Primary Examiner*—William L. Freeh
*Assistant Examiner*—R. E. Gluck
*Attorney, Agent, or Firm*—Michael C. Sudol, Jr.

[57] ABSTRACT

This case relates to a variable performance pump wherein the width of the impeller in a centrifugal pump can be regulated while the unit is operating. The impeller's width is regulated by the pump pressure and is controlled by a small external valve. The pump performance may be varied over a wide range to obtain constant head, constant capacity or other desired pumping characteristics.

3 Claims, 3 Drawing Figures

VARIABLE PERFORMANCE PUMP

BACKGROUND AND SUMMARY OF INVENTION

There are many types of pumping systems which require the pumping equipment to operate over a range of conditions rather then at a single head-capacity point. In some cases a constant pressure is required over a wide capacity range. In other systems the reverse is desired - the capacity is to be held constant while the pressure varies and still other cases the capacity is varied to meet load demands and the head required increases with capacity. The invention herein is a pump having an effective method of varying pump performance to meet varying system requirements.

Thus, it is an object of this invention to provide a variable performance pump wherein the width of the impeller in said pump is regulated while the unit is operating.

It is a further object of this invention to have the mechanism regulating the width of the impeller actuated by the pump pressure itself which is controlled by a small external valve.

It is a still further object of this invention to provide a variable performance pump whose performance can be varied over a wide range to obtain constant head, constant capacity or other desired pumping characteristics.

Further objects will become apparent from the following specification and drawings.

Basically as stated the invention herein relates to a variable performance pump having a mechanism therein for varying the performance of said pump while said pump is operating.

The performance variation is obtained by varying the impeller width. The pumping head, capacity and horsepower increase with increasing impeller width and decrease with decreasing impeller width. The impeller width is varied by use of an impeller shroud or wall which moves axially. The shroud movement is actuated by pump pressure operating against a unique piston arrangement; and it is the unique piston arrangement cooperating with a movable shroud which is the basic element of this invention. The piston location and thereby the impeller width is controlled by a small valve external to the pump which regulates the pressure at one side of the piston. The pump performance is controlled by the setting of the small external valve. This ability to regulate the pump by a small control valve is an extremely useful feature. Small hydraulic control (pilot) valves are well known in the art and are highly developed devices readily obtainable at moderate cost. Two examples are pilot valves which open or close to hold a set signal pressure or to hold a set differential pressure between two signal pressures. The single signal pressure pilot valve can vary pump performance to hold a constant pumping pressure; the set differential signal pressure valve can use the differential pressure across an orifice to vary pump performance so as to hold a constant flow rate. Other pump control variations based on the above description will be apparent to those versed in the art.

Figure 1:
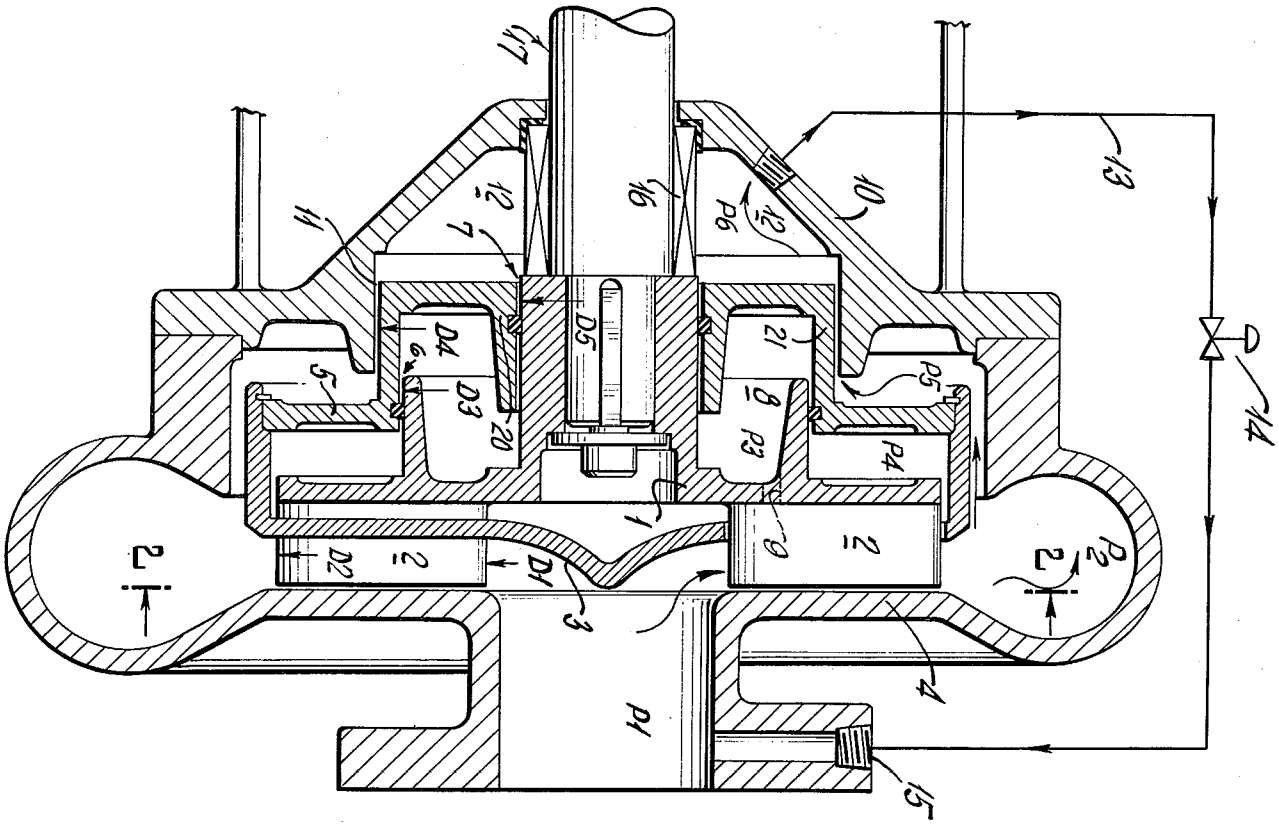
FIG. 1 is a cross section of a typical centrifugal pump with the variable performance pump of this invention.
Figure 2:
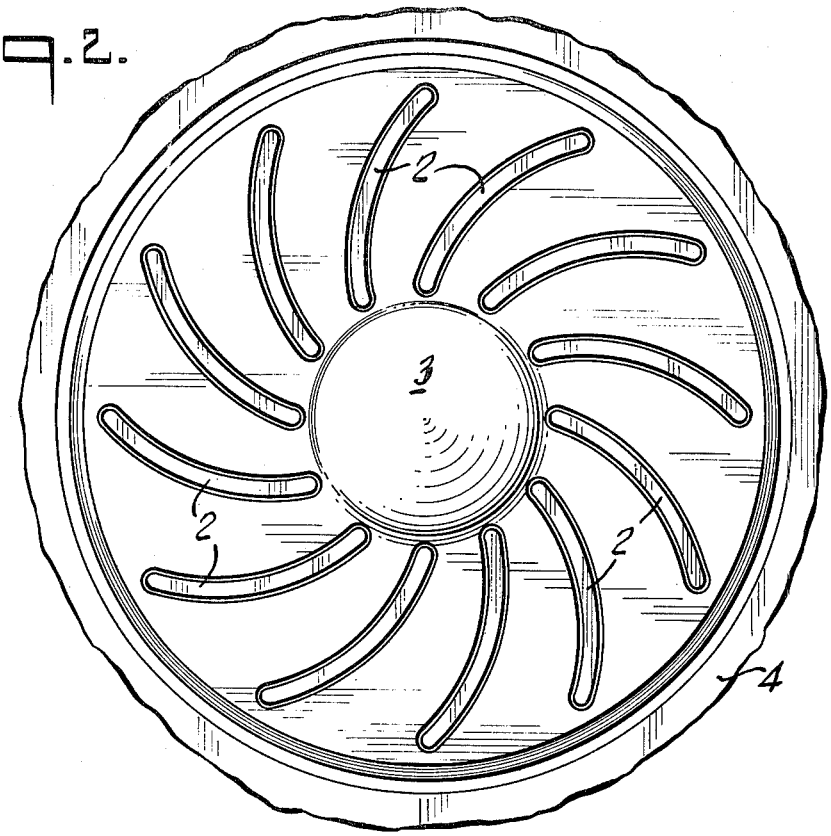
FIG. 2 is a cross section view of said pump impeller along 2—2 of FIG. 1.

Referring to FIGS. 1 and 2 in greater detail, the impeller 1 is fixed to shaft 17 in a conventional manner. The impeller vanes 2 whose shape is shown herein as curved (but which can be any other typical impeller shape such as straight out from the hub or axially offset from the hub) pass through the axially adjustable shroud 3 and have a close clearance with the volute case 4. The flow through the impeller 1 passes between the shroud 3, volute wall 4 and impeller vanes 2. The width of the flow path depends upon the axial setting of the shroud 3 relative to the volute 4. A piston 5 is connected to the shroud 3. The piston 5 which is actually the back end of shroud 3 and attached thereto rotate with the impeller 1. The piston 5 has two cylindrical fits 6 and 7 on the impeller 1 which seals the pressure cavity 8 and aligns the piston-shroud 5 and 3 arrangement so that it moves axially and rotatably. The pressure P3 within the cavity 8 is set by bleed holes 9. The holes 9 would typically be located so that P3 is midway between the impeller suction P1 and discharge P2 pressure. There is a close cylindrical fit 11 between the rotating piston 5 and the stationary backplate 10. An external line 13 with a control valve 14 connects the pressure cavity 12 with the pump suction 15. Although the connection is shown between the control valve 14 and the pressure cavity 12 it should be realized that the control valve 14 can have this end open to the atmosphere and not connected to the pump suction 15.

The piston 5 has two extending means 20, 21 thereon. Extending means 20 is movable within cylindrical fit 7 on impeller 1, extending means 21 is movable between cylindrical fits 6 and 11.

A conventional mechanical seal 16 or other means is used to prevent leakage where the shaft 17 passes through the backplate 10.

To better explain how the variable pump works, if the pressure P6 is less than P5, fluid passes through the fit 11 into the cavity 12. With valve 14 wide open, P6 is approximately the same as P1. With the valve 14 closed, P6 is approximately equal to P5 which is roughly the same as P2. P6 varies between P1 and P2 depending on the valve 14 setting. At any given diameter up the shroud from the center outward the pressure on each side of the shroud 3 is roughly equal. The shroud 3 has little net axial pressure force acting on it. P4 and P5 are approximately equal to P2 and each other so that above diameter D4 (outward from the center to the housing walls) the piston 5 has balanced axial forces acting on it. The net pressure force on the piston-shroud arrangement 5–6 is P6 times area D5 to D4 toward the impeller inlet and P3 times area D5 to D3 plus P2 times area D3 to D4 away from the impeller inlet. P6, which can be varied between P1 and P2 by the control valve 14, determines the magnitude and direction of the axial pressures forces on the piston-shroud mechanism and thereby its location within the limits of the axial travel build into the arrangement. Thus, the valve 14 setting controls the width of the impeller flow passage.

Figure 3:
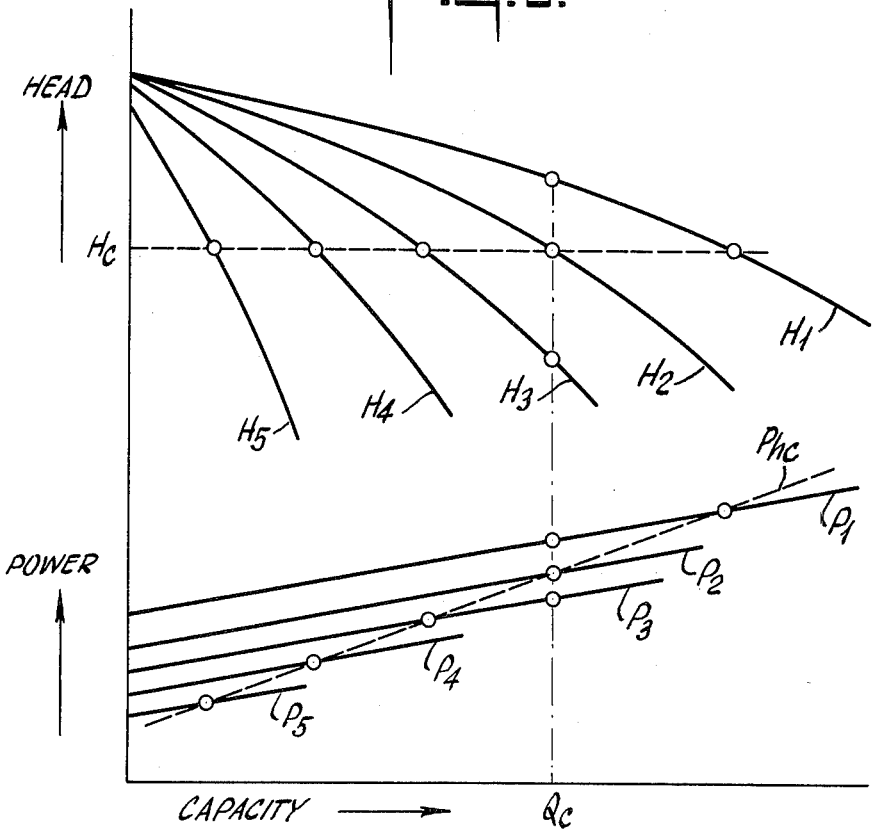
FIG. 3 is a graph showing the performance variation obtainable by regulating the impeller width of the pump of this invention.

Referring to FIG. 3, the head-capacity curves are labeled H and the power-capacity curves P. H1 and P1 are the pump performance at maximum impeller width. As the impeller width narrows, the performance progressively change to H2, P2; H3, P3; etc. Phc is power-capacity curve for a constant head, Hc. Qc shows how the head and power could vary if the flow were held constant.

Those versed in the art will recognize that the unique piston-arrangement may be adapted to most of the normal variations in centrifugal pump and turbine design such as open, closed and semi-open impellers, single and multistage units, etc.

The invention may be embodied in other specific forms without departing from the spirit or essential characteristics hereof. The embodiment and the modification described are therefore to be considered in all respects as illustrative and not restrictive, the scope of the invention being indicated by the appended claims rather than by the foregoing description, and all changes which come within the meaning and range of equivalence of the claims are therefore intended to be embraced therein.

What is claimed is:

1. A variable width impeller centrifugal pump comprising a. a rotatable impeller having vanes thereon and holes therethrough and having two concentric cylindrical fits on the back side thereof; b. an impeller shroud having slots thereon through which the vanes of said impeller pass. c. a pump housing having an inlet and outlet section encompassing the impeller and impeller shroud, said pump housing having one cylindrical fit integral with said housing, said housing having an opening therein on the back side thereof; d. a piston arrangement integral with said impeller shroud adapted for axial and rotatable movement having two extending means thereon to axially move within the three cylindrical fits said extending means being movable between the cylindrical fit on said housing and one of said cylindrical fits on said impeller, the others of said extending means being movable within the other of said cylindrical fits on said impeller so that an area on the impeller side of said piston is sealed by said impeller cylindrical fits, said area communicating with said inlet by means of said holes through said impeller, said piston also being partially sealed by said cylindrical fit on said housing so that leakage through said fit on said housing provides pressure to the piston on the side opposite said impeller; e. means for controlling the pressure on the piston side away from the impeller, said means communicating with the inside of said housing through the opening in the rear of said housing.

2. A variable width impeller centrifugal pump of claim 1 wherein the means for controlling the pressure on the piston side away from the impeller is a pressure drain valve.

3. A variable width impeller centrifugal pump of claim 2 wherein the pressure drain valve communicates with the inlet region of said housing.

* * * * *

UNITED STATES PATENT AND TRADEMARK OFFICE

CERTIFICATE OF CORRECTION

PATENT NO. : 4,070,132

DATED : January 24, 1978

INVENTOR(S) : CHARLES THOMAS LYNCH

It is certified that error appears in the above-identified patent and that said Letters Patent are hereby corrected as shown below:

Col. 4, line 5, after the word "fits" insert -- , one of --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*